US006658233B1

(12) United States Patent
Ikeda

(10) Patent No.: US 6,658,233 B1
(45) Date of Patent: Dec. 2, 2003

(54) SATELLITE BROADCAST RECEIVING CONVERTER

(75) Inventor: Tomoki Ikeda, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 602 days.

(21) Appl. No.: 09/677,809

(22) Filed: Oct. 3, 2000

(30) Foreign Application Priority Data

Oct. 4, 1999 (JP) ..... 11-283534

(51) Int. Cl.[7] ..... H04K 3/00

(52) U.S. Cl. ..... 455/12.1; 455/1; 455/4.27; 455/81; 455/131

(58) Field of Search ..... 455/1, 427, 81, 455/12.1, 131, 9, 90.3, 328, 323; 333/21 A, 33, 26; 439/579

(56) References Cited

U.S. PATENT DOCUMENTS 4,058,813 A 11/1977 Risko
4,679,249 A * 7/1987 Tanaka et al. ..... 455/328
4,837,524 A * 6/1989 Nakamura ..... 333/26
4,896,163 A * 1/1990 Shibata et al. ..... 333/21 A
5,225,799 A 7/1993 West et al.
5,365,246 A 11/1994 Bonek et al.
6,127,901 A * 10/2000 Lynch ..... 333/26
6,168,465 B1 * 1/2001 Hirota ..... 439/579
6,389,274 B1 * 5/2002 Piloni et al. ..... 455/325

FOREIGN PATENT DOCUMENTS

| | | |
|---|---|---|
| EP | 0 899 812 | 3/1999 |
| GB | 2 334 153 | 8/1999 |
| JP | 11-17573 | 1/1999 |
| JP | 11-74809 | 3/1999 |

* cited by examiner

*Primary Examiner*—Quochien Vuong
*Assistant Examiner*—Lana Le
(74) *Attorney, Agent, or Firm*—Brinks Hofer Gilson & Lione

(57) ABSTRACT

A satellite broadcast receiving converter has a housing, a waveguide, and a short-circuit wall, which are stamped out of a single metal sheet and are then folded.

9 Claims, 12 Drawing Sheets

SATELLITE BROADCAST RECEIVING CONVERTER

BACKGROUND OF THE INVENTION

1. Field of the Invention

The present invention generally relates to satellite broadcast receiving converters, and more specifically to a satellite broadcast receiving converter which is used to receive satellite broadcasts and satellite communications, and which receives circularly polarized waves having a vertical polarization component and a horizontal polarization component.

2. Description of the Related Art

Referring to FIGS. 10 to 13, there is shown a conventional satellite broadcast receiving converter. FIG. 10 is a perspective view of the converter, and FIG. 11 is a sectional view thereof taken along such a line XI—XI of FIG. 10. FIG. 12 is a partially enlarged view of the converter, showing how a probe is installed. FIG. 13 is a partially enlarged view of the converter, showing a circuit board mounted therein.

A housing 31 and a waveguide 32 are manufactured by die-casting with a metal such as aluminum or zinc and then forming the components into one unit. The housing 31 is formed into a substantially rectangular box, including a bottom wall 31*a,* side walls 31*b* that are vertical and which surround the bottom wall 31*a,* a housing portion 31*c* that is uncovered and is defined by the side walls 31*b,* a penetrating hole 31*d* formed in the bottom wall 31*a* in the vicinity of one end thereof and extending perpendicularly thereto, and a stepped portion 31*e* having a step along an upper periphery of the side walls 31*b.* The waveguide 32 is a relatively narrow cylinder, extending from the bottom wall 31*a* at a position corresponding to the penetrating hole 31*d.* The waveguide 32 includes a substantially cylindrical tube section 32*b* having an opening 32*a* from which polarized waves are guided, a hollow 32*c* formed lengthwise at the center of the tube section 32*b,* and a holder portion 32*d.* The holder portion 32*d* is a semi-columnar recess, as shown in FIG. 12, which is formed in the tube section 32*b* to extend toward the opening 32*a* from a portion of the periphery of the penetrating hole 31*d* of the housing 31.

A probe 33 for detecting horizontally polarized waves is composed of a tubular insulator 33*a* made of resin such as fluorine resin, polyethylene, or Teflon, and a linear core conductor 33*b* passing through the insulator 33*a* at the center thereof and mainly made of a metal such as brass or nickel. The core conductor 33*b* is formed into substantially an L-shape, leading to a first end 33*c* while the other end thereof, namely a second end 33*d,* is formed at the tip of the straight part.

Referring to FIG. 12, the insulator 33*a* is forced into the holder portion 32*d* in the waveguide 32, allowing the probe 33 to be installed into the waveguide 32. Once the probe 33 has been installed, the second end 33*d* of the core conductor 33*b* protrudes into the housing portion 31*c* of the housing 31 while the first end 33*c* extends into the hollow 32*c* of the waveguide 32.

In FIG. 13, there is shown a rectangular circuit board 34 formed of a single insulating sheet. The circuit board 34 includes a thin flat plate 34*a,* three penetrating holes 34*b* formed in the vicinity of a side edge of the plate 34*a* and extending perpendicularly thereto, bridges 34*d* and 34*e* defining the penetrating holes 34*b* to form a T-shape, and a small opening 34*c* formed in the vicinity of the penetrating holes 34*b.* A copper ground conductor 35 is formed on the underside of the circuit board 34 except for the underside of the bridge 34*e,* and the underside of the bridge 34*d* serves as a short-circuit for the probe 33.

A probe 36 for detecting vertically polarized waves is formed across the bridge 34*e* with a conductive pattern, and extends from the intersection of the bridges 34*d* and 34*e* toward the plate 34*a* of the circuit board 34. In turn, the probe 36 is connected to a circuit pattern (not shown) formed on the top of the plate 34*a.* The circuit board 34 is contained on the bottom wall 31*a* of the housing 31 so that the penetrating hole 31*d* may communicate with the penetrating holes 34*b* in the plate 34*a.* Also, the second end 33*d* of the core conductor 33*b* of the probe 33 is inserted in the opening 34*c* in the plate 34*a,* and the circuit board 34 is then fixed to the bottom wall 31*a* of the housing 31 by any appropriate means. The second end 33*d* of the core conductor 33*b* that protrudes from the circuit board 34 is soldered by a solder 37 to the circuit pattern.

A box-shaped metallic short-circuit wall 38 is formed by aluminum or zinc die-casting. The short-circuit wall 38 is mounted to the circuit board 34 by an appropriate technique such as caulking so as to cover the penetrating holes 34*b* in the circuit board 34. The short-circuit wall 38 has a base 38*a* acting as a short-circuit for the probe 36.

A cover 39 formed of a single rectangular metal sheet is placed on the step 31*e* of the side walls 31*b* of the housing 31, and is fixed thereto by an appropriate technique. Accordingly, the housing portion 31*c* of the housing 31 is closed and electrically shielded.

Such a conventional satellite broadcast receiving converter is of the type in which the housing 31 and the waveguide 32 are manufactured by die-casting such as aluminum die-casting and then forming the components into one unit. Therefore, a large number of materials are required, resulting in increased material costs as well as prolonged manufacturing time. This makes the converter expensive and less efficient in production.

In addition, the following problem also occurs with such a conventional satellite broadcast receiving converter. The housing 31 and the waveguide 32 have different sizes and configurations, and therefore more complex and expensive die-casting molds are required. This also makes the converter more expensive.

SUMMARY OF THE INVENTION

Accordingly, it is an object of the present invention to provide a satellite broadcast receiving converter which has superior production efficiency and is inexpensive.

To this end, a satellite broadcast receiving converter according to the present invention has a metal housing formed into a box, a tubular waveguide, and a box-shaped short-circuit wall which opposes the waveguide so as to communicate with a hollow formed in the waveguide, wherein the housing, the waveguide, and the short-circuit wall are joined together on a single metal sheet. These components are stamped out of the metal sheet, and then folded. With this feature, the number of materials making up the converter can be reduced. A simple manufacturing process as well as shortened manufacturing time can also be obtained.

The converter may include a circuit board on which an electric circuit is formed, wherein the circuit board is held by and between the housing and an end of the waveguide. This enables the circuit board to be held therebetween in a simple manner.

Preferably, the waveguide includes a hooking tab at a free-end edge of the end thereof, which is engaged with the circuit board. The use of a hooking tab ensures that the waveguide is mounted and positioned to the circuit board in a simple manner.

Preferably, a folding guide line is formed in a joining portion joining the housing with the waveguide, and the folding guide line may include cuts. The folding guide line facilitates folding of the waveguide at a predetermined position, so that the circuit board can be easily mounted to the waveguide.

Accordingly, the present invention provides for a satellite broadcast receiving converter with a simple configuration having high production efficiency as well as high reliability. There is no need for an expensive die-casting mold, so that an inexpensive satellite broadcast receiving converter can be obtained.

DESCRIPTION OF THE PRESENTLY PREFERRED EMBODIMENTS

A satellite broadcast receiving converter in accordance with the present invention is now described with reference to FIGS. 1 to 9.

Figure 1:
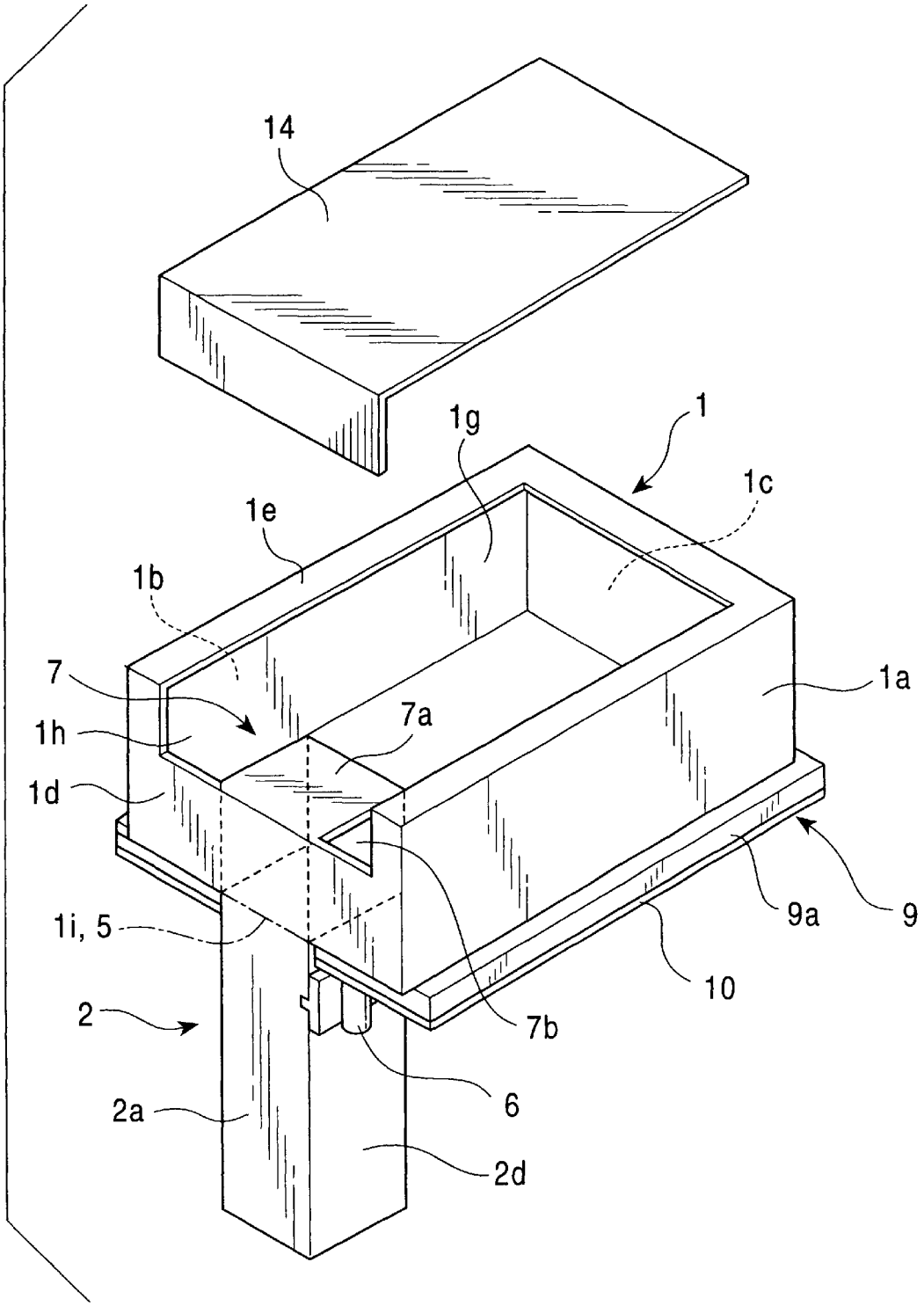
FIG. 1 is an enlarged perspective view of a satellite broadcast receiving converter in accordance with the present invention.
Figure 2:
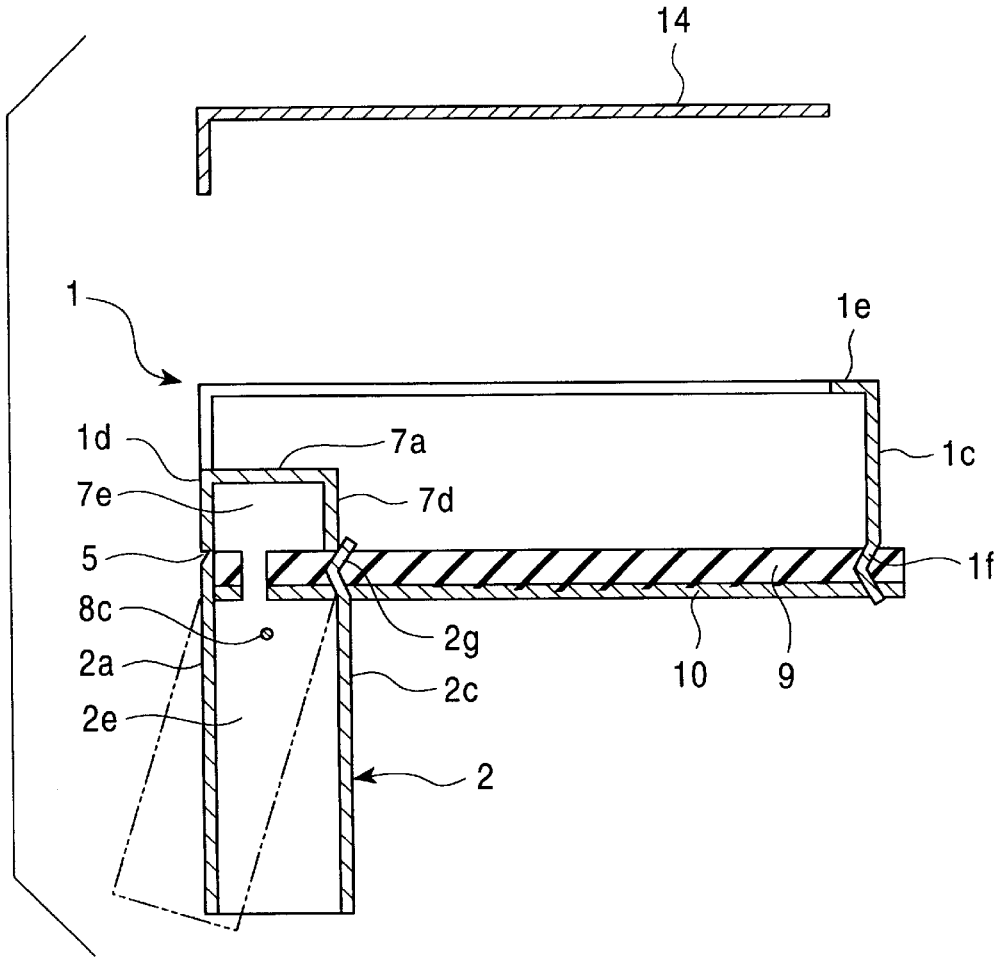
FIG. 2 is an enlarged sectional view of the satellite broadcast receiving converter of FIG. 1.
Figure 3:
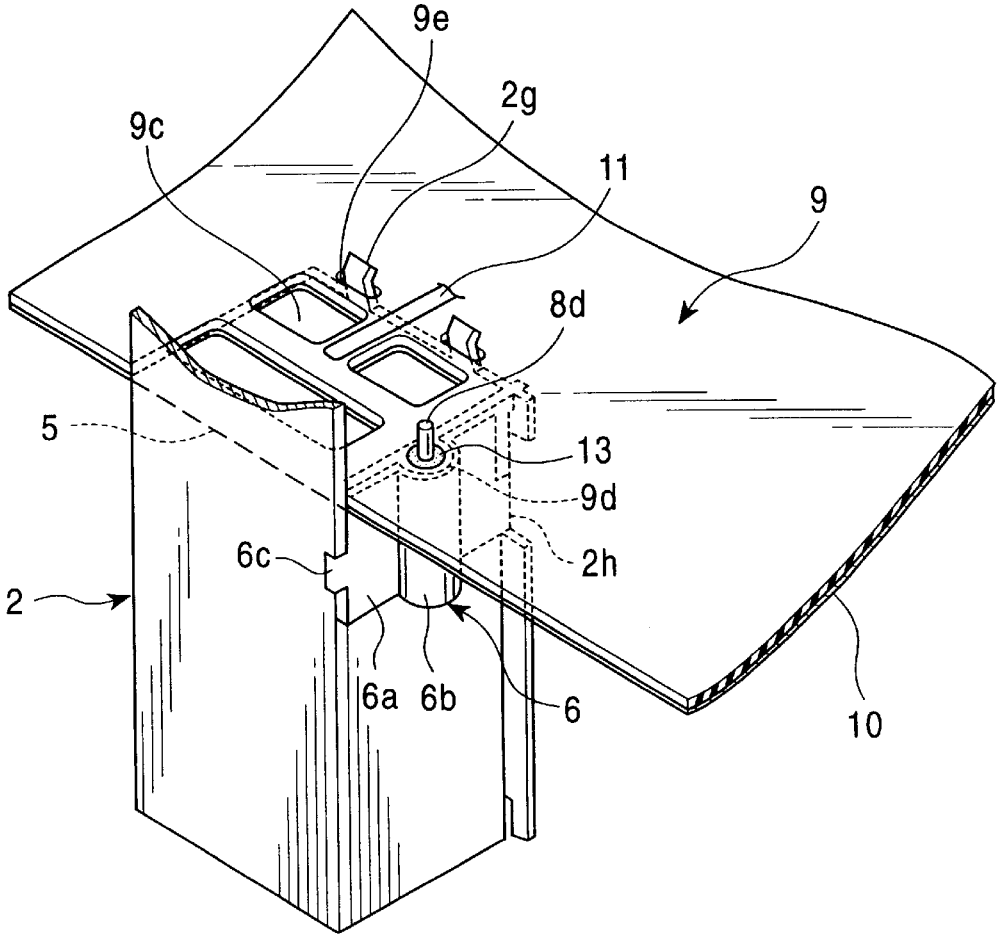
FIG. 3 is a perspective view of the satellite broadcast receiving converter, showing that a waveguide and a circuit board are connected to each other.
Figure 4:
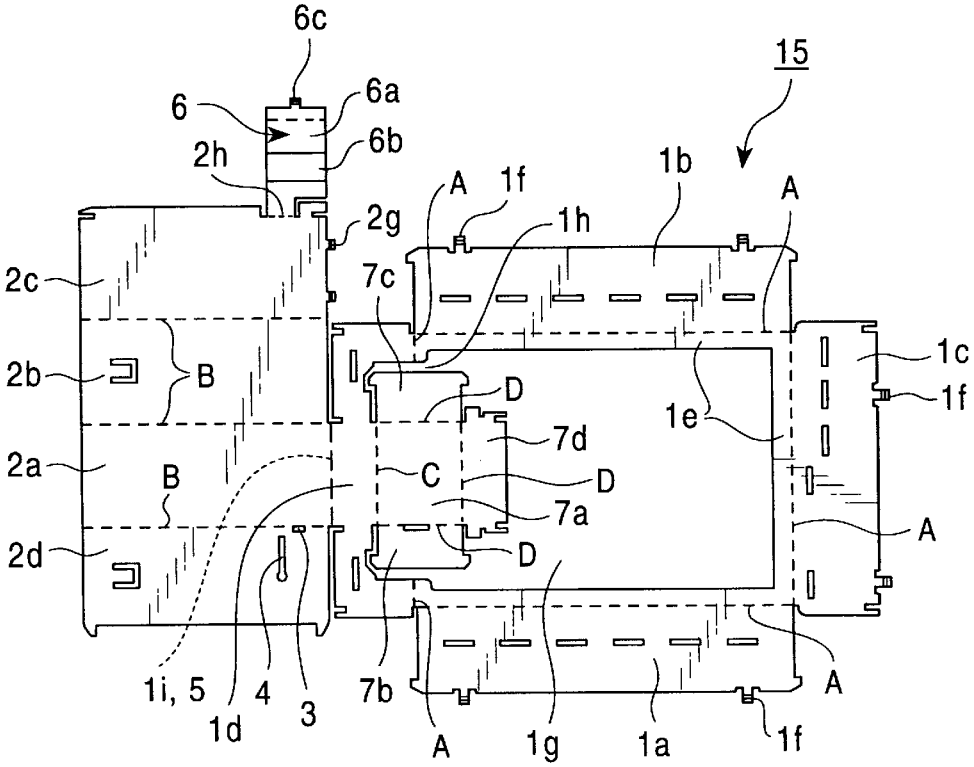
FIG. 4 is a developed view of a semi-finished product member, for illustrating the assembly of the satellite broadcast receiving converter.
Figure 5:
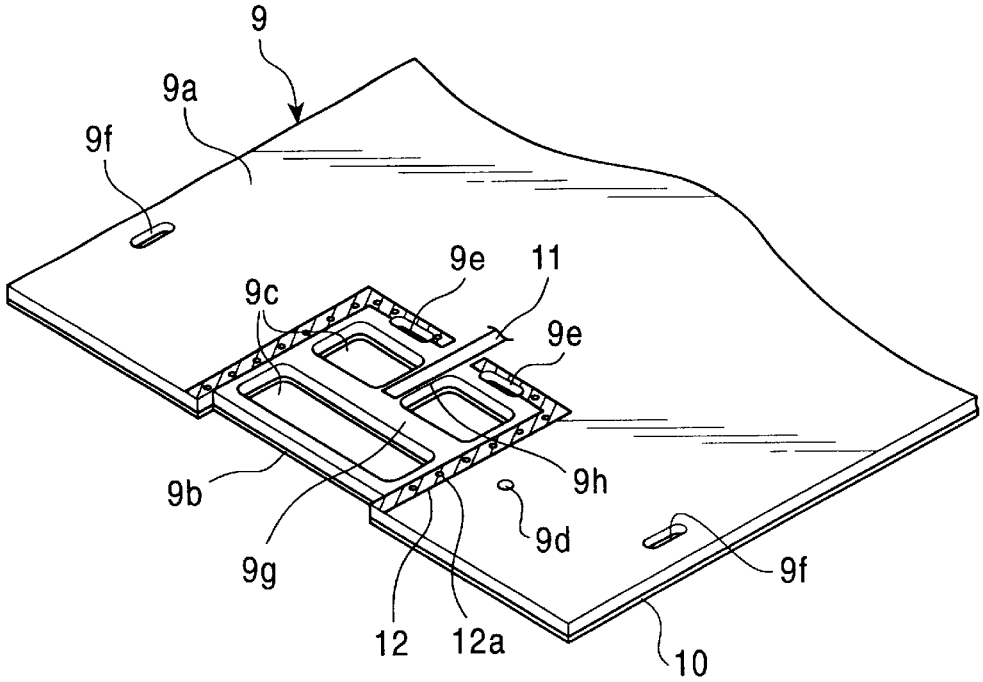
FIG. 5 is an enlarged view of the circuit board employed in the satellite broadcast receiving converter.
Figure 6:
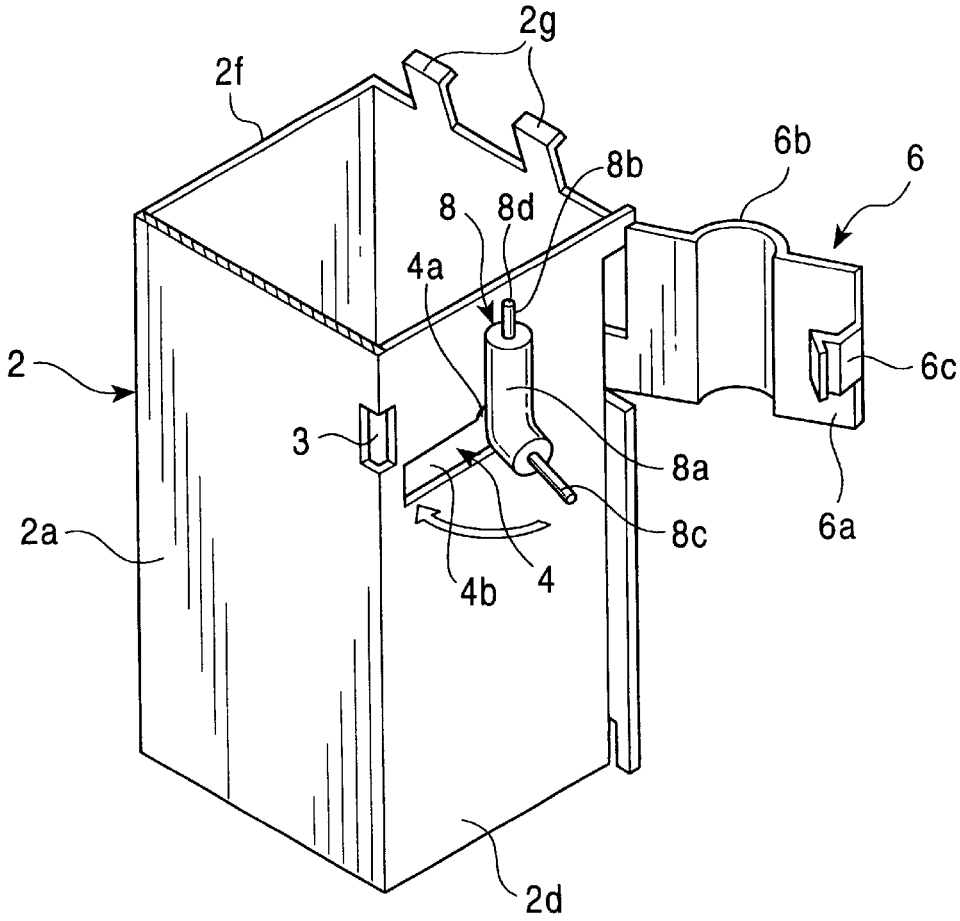
FIG. 6 is a perspective view of the satellite broadcast receiving converter, showing that a probe is installed.
Figure 7:
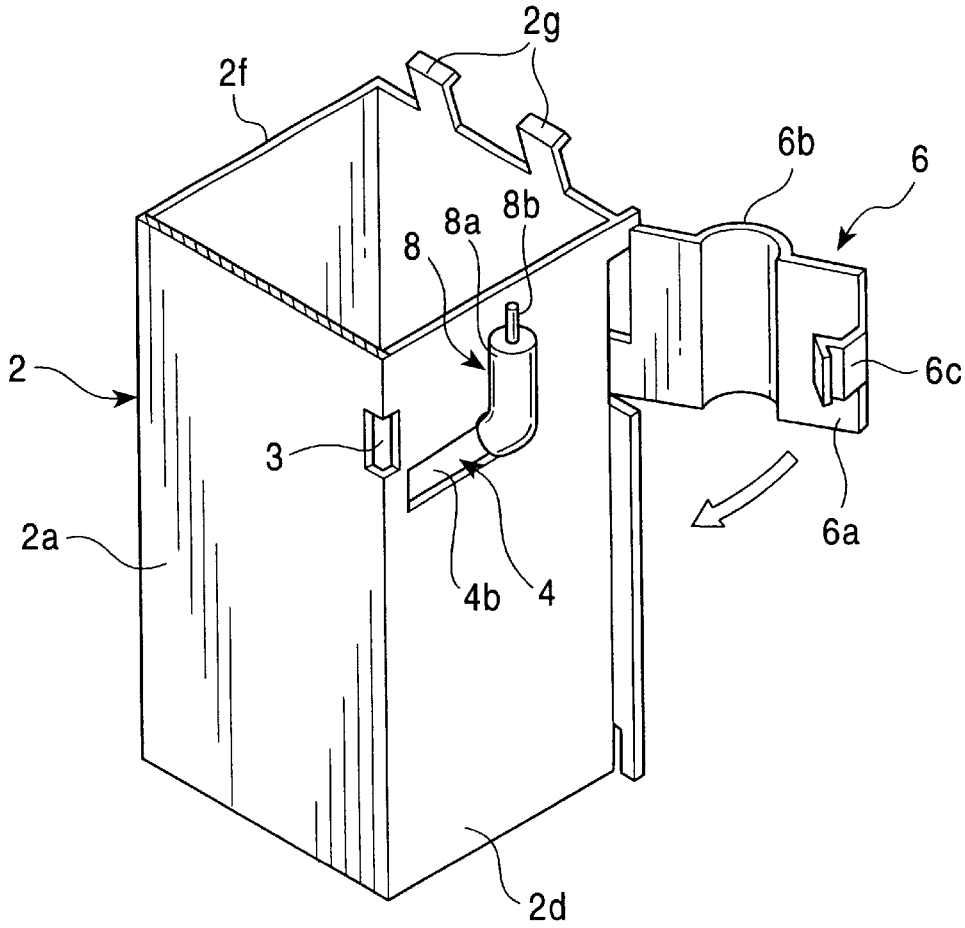
FIG. 7 is a perspective view of the satellite broadcast receiving converter, showing that the probe is installed.
Figure 8:
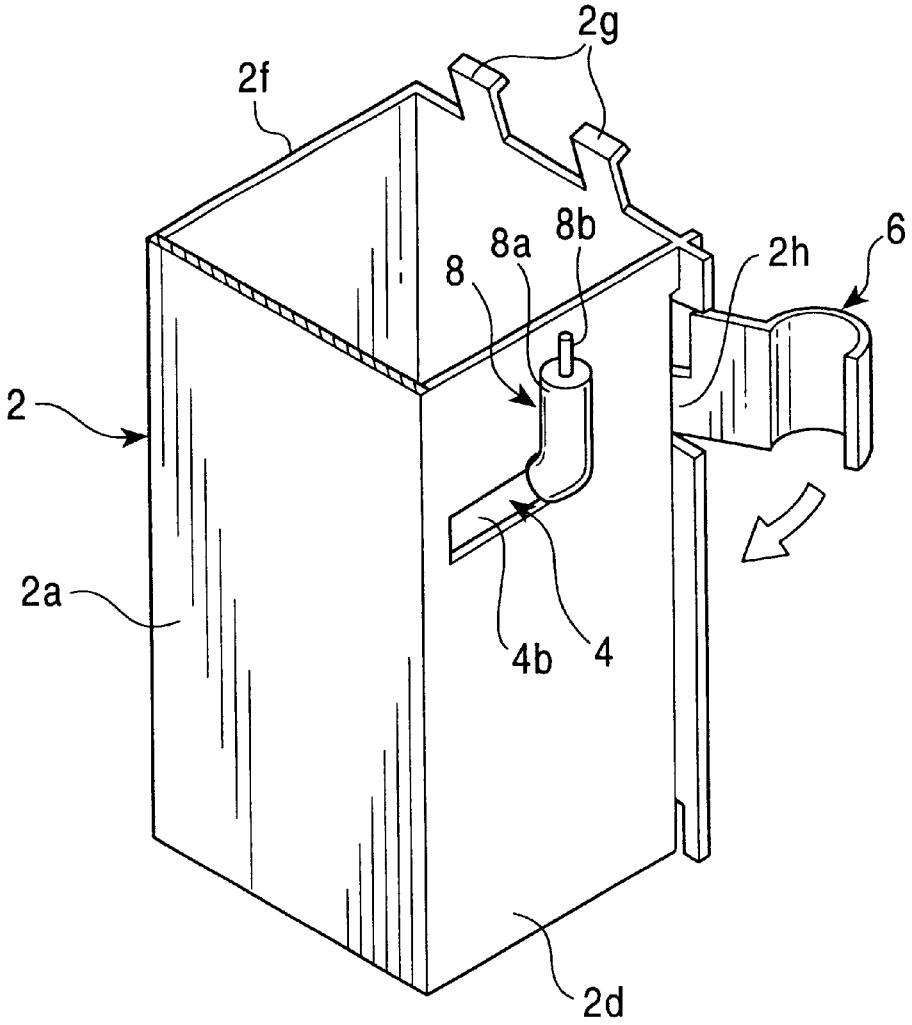
FIG. 8 is a perspective view showing a modification of a holder portion in the satellite broadcast receiving converter.
Figure 9:
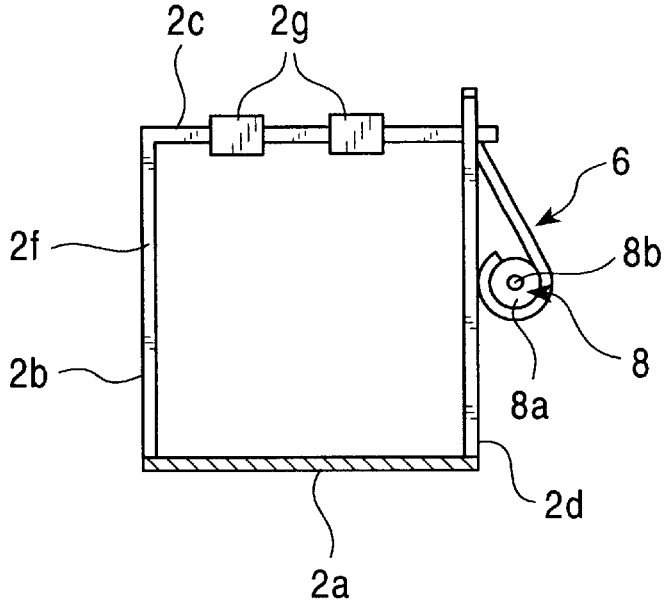
FIG. 9 is a top plan view showing another modification of a holder portion in the satellite broadcast receiving converter.
Figure 10:
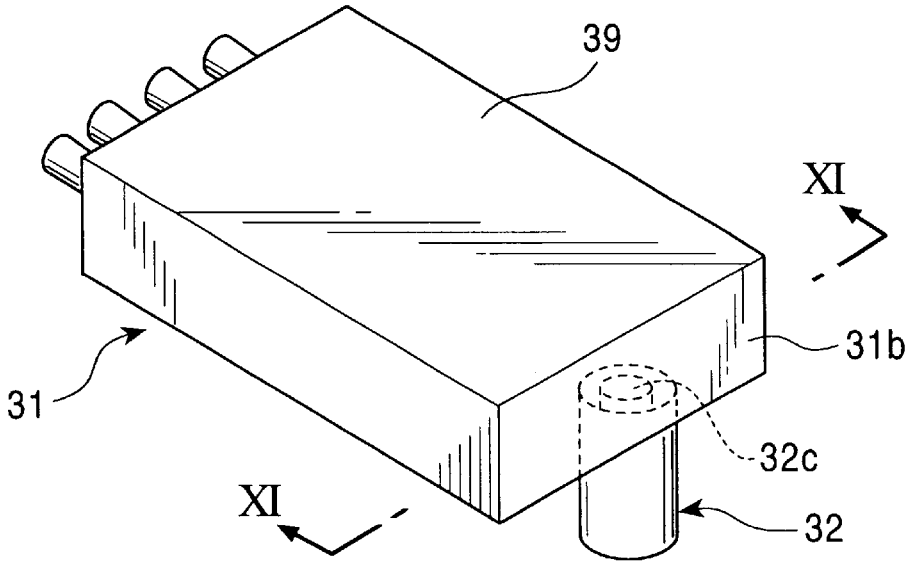
FIG. 10 PRIOR ART
FIG. 10 is a perspective view of a conventional satellite broadcast receiving converter.
Figure 11:
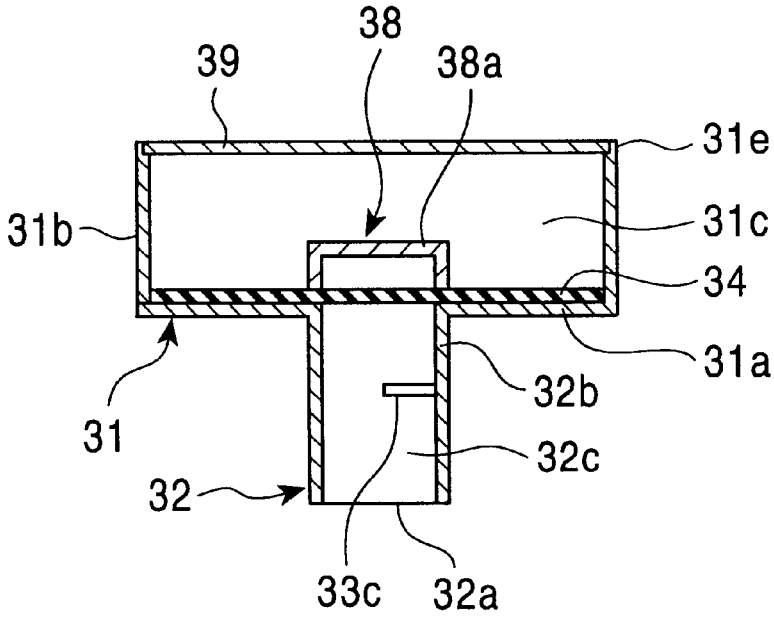
FIG. 11 PRIOR ART
FIG. 11 is a sectional view of the converter, taken along the line XI—XI of FIG. 10.
Figure 12:
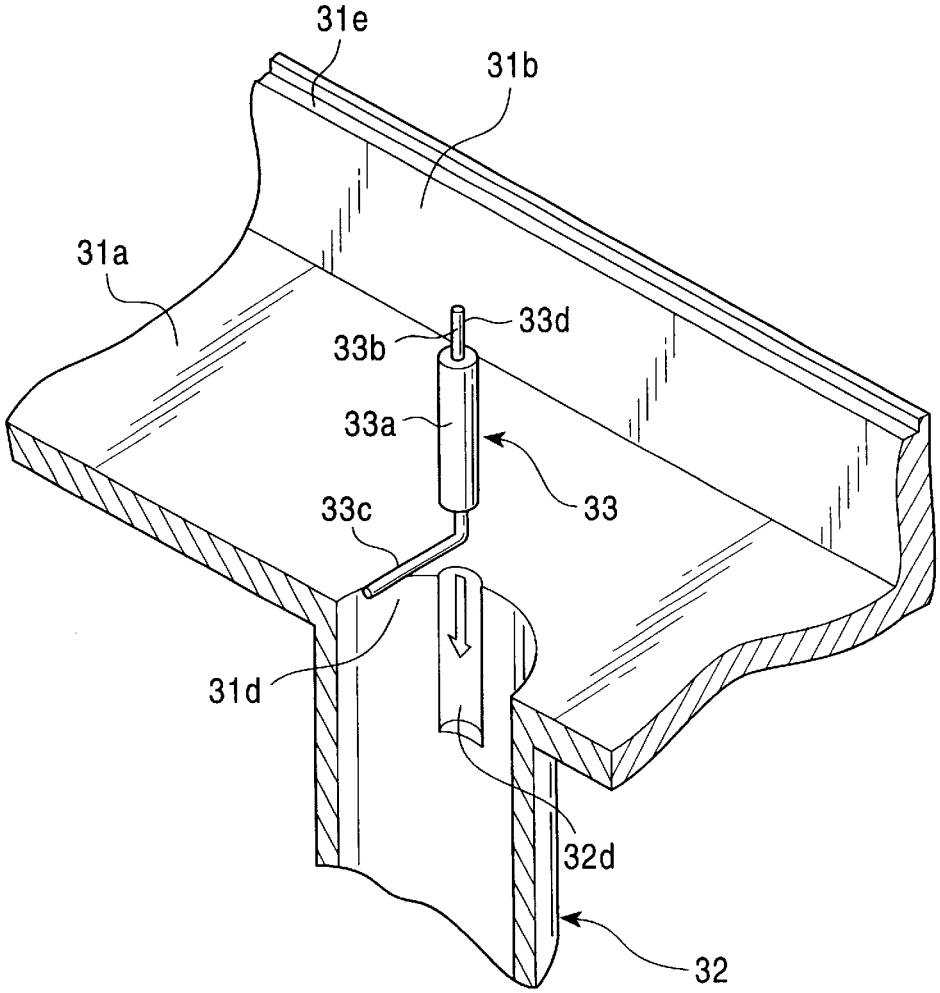
FIG. 12 PRIOR ART
FIG. 12 is a partially enlarged view of the conventional satellite broadcast receiving converter, showing how a probe is installed.
Figure 13:
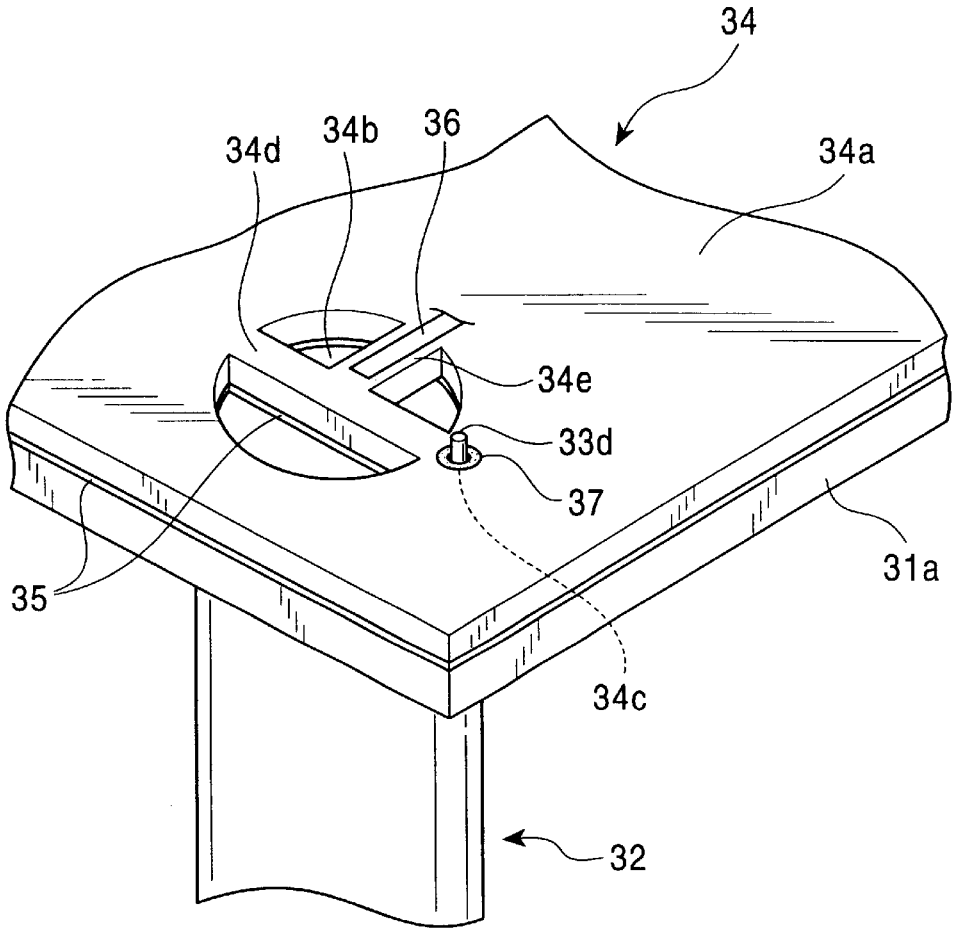
FIG. 13 PRIOR ART
FIG. 13 is a partially enlarged view of the conventional satellite broadcast receiving converter, showing a mounted circuit board.

FIG. 1 is an enlarged perspective view of a satellite broadcast receiving converter in accordance with the present invention, and FIG. 2 is an enlarged sectional view of the converter. FIG. 3 is an illustration of the converter, showing that a waveguide and a circuit board are connected to each other. FIG. 4 is a developed view of a semi-finished product member, for illustrating the assembly of the converter. FIG. 5 is an enlarged view of the circuit board in the converter. FIGS. 6 and 7 both illustrate that a probe is installed into the converter. FIG. 8 is a perspective view showing a modification of a holder portion in the converter. FIG. 9 is a top plan view showing another modification of a holder portion in the converter.

Throughout these figures, according to the satellite broadcast receiving converter of the present invention, a housing 1, a waveguide 2 and a short-circuit wall 7 are joined together on a single thin metal sheet. These components are stamped out of the metal sheet and folded.

The housing 1 is formed into a box and is made of a thin metal sheet. The housing 1 has a rectangular recess 1*g* formed at the center thereof and a rectangular U-shaped top wall 1*e* that forms an edge of the periphery thereof. At the four sides of the top wall 1*e,* folded down side walls 1*a,* 1*b,* 1*c,* and 1*d* are provided so as to be upright. Each of the side walls 1*a,* 1*b,* 1*c* and 1*d* is joined with the top wall 1*e.* An upper portion of the side wall 1*d* that opposes the side wall 1*c* is formed with a large cut-out indented portion 1*h,* which extends across the width of the recess 1*g.* As shown in FIG. 4, a plurality of substantially V-shaped hooking tabs 1*f* are formed at an edge of each of the side walls 1*a,* 1*b* and 1*c.*

The waveguide 2 is made of a thin metal sheet of a rectangular tube, including side panels 2*a,* 2*b,* 2*c,* and 2*d,* and a hollow 2*e.* The side panel 2*a* extends down from a joining portion 1*i* and the side wall 1*d* of the housing 1. The side panels 2*b* and 2*d* are angled at 90° relative to the side panel 2*a*. The side panel 2*c* is angled at 90° relative to the side panel 2*b,* and is joined with the side panel 2*d* so as to face the side panel 2*a*. The hollow 2*e* is defined by the side panels 2*a,* 2*b,* 2*c* and 2*d*. The side panels 2*b,* 2*c* and 2*d* provide ends 2*f* (see FIG. 6) that lie on free-end edges opposite to the joining portion 1*i*. As shown in FIGS. 2 and 3, two substantially V-shaped hooking tabs 2*g* are formed on the end 2*f* of the side panel 2*c* opposing the side panel 2*a* joined with the housing 1. In FIG. 4, a substantially rectangular engagement hole 3 is formed in the boundary between the side panels 2*a* and 2*d,* and an insertion hole 4 composed of a round hole portion 4*a* and a square hole portion 4*b* is formed in the side panel 2*d* in the vicinity of the engagement hole 3. The joining portion 1*i* for joining the side panel 2*a* with the side wall 1*d* of the housing 1 includes a folding guide line 5 having cuts. The waveguide 2 extends perpendicularly to the housing 1 when it is folded and assembled, as shown in FIG. 1. The waveguide 2 can be tilted on the folding guide line 5 relative to the housing 1, as indicated by the dotted lines in FIG. 2.

Referring to FIGS. 3 and 4, a holder portion 6 adjoins the side panel 2*c* by a joining portion 2*h* so as to be outside the waveguide 2. The holder portion 6 includes a body 6*a* of a flat sheet, a curved enclosing section 6*b* formed at the center of the body 6*a,* and a substantially V-shaped hooking tab 6*c* folded at an end of the holder portion 6, which lies on a free-end edge.

The holder portion 6 can be folded down relative to the side panel 2*c* so that the hooking tab 6*c* can be engaged with the engagement hole 3 when the holder portion 6 is folded down to the side panel 2*d.*

A short-circuit wall 7 is made of a thin metal sheet of a box-shape, including a lid 7*a,* side portions 7*b,* 7*c,* and 7*d,* and a cavity 7*e.* The lid 7*a* adjoins the side wall 1*d* of the housing 1, and is folded 90° relative to the side wall 1*d.* The side portions 7*b,* 7*c,* and 7*d* are folded down relative to the lid 7*a.* The cavity 7*e* is defined by the lid 7*a,* the side portions 7*b,* 7*c,* and 7*d,* and the side wall 1*d.*

The short-circuit wall 7 is located in the housing 1 with the cavity 7*e* communicating with the hollow 2*e* of the waveguide 2.

Shown in FIG. 6 is a probe 8 for detecting horizontally polarized waves, including an L-shaped tubular insulator 8*a* made of resin such as fluorine resin, polyethylene, or Teflon, and a linear core conductor 8*b* passing through the center of the insulator 8*a* and mainly made of a metal such as brass or nickel. The core conductor 8*b* is bent substantially at a right angle together with the insulator 8*a,* leading to a first end 8*c* while the other end thereof, namely a second end 8*d,* is positioned substantially at a right angle relative to the first end 8*c*.

Referring to FIGS. 3 and 7 in particular, the arrangement of the probe 8 is such that one end of the L-shaped insulator 8*a* is fitted into the round hole 4*a* of the insertion hole 4 formed in the side panel 2*d* of the waveguide 2 while the other end of the insulator 8*a* appearing from the waveguide 2 is held between an outer surface of the side panel 2*d* of the waveguide 2 and the enclosing section 6*b* of the holder portion 6. The enclosing section 6*b* of the holder portion 6 encloses the portion of the insulator 8*a* which appears from the waveguide 2 to hold the insulator 8*a* so that the portion of the core conductor 8*b* which appears from the waveguide 2 can be enclosed by the enclosing section 6*b*.

When the probe 8 is installed, the second end 8*d* of the core conductor 8*b* projects into the housing 1 while the first end 8*c* extends into the hollow 2*e* of the waveguide 2.

In FIG. 5, there is shown a rectangular circuit board 9 made of a single insulating sheet, including a thin flat plate 9*a,* an indented portion 9*b* formed at one side of the plate 9*a,* three substantially rectangular penetrating holes 9*c* formed in the vicinity of the indented portion 9*b* and extending perpendicularly thereto, bridges 9*g* and 9*h* defining the penetrating holes 9*c* to form a T-shape, a small opening 9*d* formed in the vicinity of the penetrating holes 9*c,* two first engagement holes 9*e* formed in the vicinity of the penetrating holes 9*c* at the position opposite to the indented portion 9*b,* and a plurality of second engagement holes 9*f* formed at the peripheral edge of the circuit board 9. A copper ground conductor 10 is formed on the underside of the plate 9*a* except for the underside of the bridge 9*h*.

A probe 11 for detecting vertically polarized waves is formed across the bridge 9*h* with a conductive pattern so as to extend from the intersection of the bridges 9*g* and 9*h* toward the plate 9*a* of the circuit board 9. The probe 11 is connected to a wiring pattern (not shown) formed on the top of the plate 9*a*. A strip-type copper ground pattern 12 encloses the penetrating holes 9*c* in the flat plate 9*a* so as to be connected with the ground conductor 10 via a plurality of through-holes 12*a* formed in the circuit board 9.

When the circuit board 9 is held between the housing 1 and the waveguide 2, the top surface of the flat plate 9*a* is brought into contact with the bottom ends of the side walls 1*a,* 1*b,* 1*c,* and 1*d* of the housing 1 while the undersurface of the flat plate 9*a* is brought into contact with and supported by the ends 2*f* of the waveguide 2. The hooking tabs 2*g* of the waveguide 2 are engaged with the first engagement holes 9*e,* and the hooking tabs 1*f* of the housing 1 are engaged with the second engagement holes 9*f,* whereby the circuit board 9 can be held between the housing 1 and the waveguide 2.

Also, the top surface of the flat plate 9*a* of the circuit board 9 is brought into contact with the bottom ends of the side portions 7*b,* 7*c,* and 7*d* of the short-circuit wall 7, and the side panel 2*a* of the waveguide 2 is engaged with the indented portion 9*b* of the flat plate 9*a*.

As shown in FIG. 3., the penetrating holes 9*c* in the circuit board 9 communicates with both the hollow 2*e* of the waveguide 2 and the cavity 7*e* of the short-circuit wall 7, and the side portions 7*b,* 7*c,* and 7*d* of the short-circuit wall 7 are in contact with the ground pattern 12. The second end 8*d* of the core conductor 8*b* of the probe 8 is inserted through the opening 9*d* in the flat plate 9*a*. The second end 8*d* of the core conductor 8*b* that projects from the circuit board 9 is soldered by a solder 13, and is connected to a wiring pattern formed on the circuit board 9.

That is, the penetrating holes 9*c* in the circuit board 9 are located within the waveguide 2 as well as within the short-circuit wall 7, and the underside of the circuit board 9 except for the underside of the bridge 9*h* is shielded with the ground conductor 10.

An L-shaped cover 14, which is formed of a single rectangular metal sheet, is seated so as to match the side wall 1*d* and the top wall 1*e* of the housing 1, and is then fixed by an appropriate technique. This allows the housing 1 to be closed and electrically shielded.

Now, an assembling process of the thuly arranged satellite broadcast receiving converter according to the present invention is described. FIG. 4 illustrates a semi-finished product member 15 composed of the housing 1, the waveguide 2 and the short-circuit wall 7. In the housing 1, the top wall 1*e* includes the recess 1*g* and the indented portion 1*h* at the center thereof, and the side walls 1*a,* 1*b,* 1*c,* and 1*d* extend from the four sides of the top wall 1*e*. In the waveguide 2 which is designed to be outside the housing 1, the side panel 2*a* is continuous with the side wall 1*d*. The side panels 2*b* and 2*c* continuously extend from one side of the side panel 2*a,* and the side panel 2*d* is continuous with the other side of the side panel 2*a*. The holder portion 6 is further continuous with the side panel 2*c* via the joining portion 2*h*. In the short-circuit wall 7 stretching into the recess 1*g* over the indented portion 1*h* in the housing 1, the lid 7*a* is opposite to the side panel 2*a* via the side wall 1*d,* and the side portions 7*b,* 7*c,* and 7*d* extend outward from the lid 7*a*. The housing 1, the waveguide 2 and the short-circuit wall 7 are stamped out of a thin metal sheet to develop the semi-finished product member 15.

In assembly, the side walls 1*a,* 1*b,* 1*c,* and 1*d* are folded by 90° at dotted lines A, to form the housing 1. The side panels 2*b,* 2*c,* and 2*d* are folded by 90° at dotted lines B and the side panels 2*c* and 2*d* are then connected to each other, forming the waveguide 2. The lid 7*a* is folded by 90° at a dotted line C and the side portions 7*b,* 7*c,* and 7*d* are folded by 90° at dotted lines D, forming the short-circuit wall 7. The configuration illustrated in FIG. 1 is thus obtained.

The installation of the circuit board 9 will now be described with reference to FIGS. 2 and 3. In FIG. 2, the waveguide 2 extending perpendicularly to the housing 1 is tilted on a folding guide line 5 outward relative to the housing 1 as indicated by the dotted lines of FIG. 2 before positioning the circuit board 9. Then, the waveguide 2 is returned to the expected position to engage with the circuit board 9. In order to achieve this operation, first, the hooking tabs 1*f* of the housing 1 are engaged with the second engagement holes 9*f* in the circuit board 9 and the circuit board 9 is disposed beneath the housing 1. Then, in the waveguide 2, the hooking tabs 2*g* on the end 2*f,* which lies on a free-end edge opposing to the side panel 2*a* continuous with the joining portion 1*i,* are engaged with the first engagement holes 9*e* in the circuit board 9 as shown in FIG. 3. This ensures that the circuit board 9 is held between the housing 1 and the waveguide 2.

The installation of the probe 8 into the insertion hole 4 will now be described with reference to FIG. 6. The probe 8 is turned in the direction indicated by the arrow of FIG. 6 to guide the first end 8*c* of the core conductor 8*b* into the hollow 2*e,* followed by catching the insulator 8*a* against the round hole 4*a,* as shown in FIG. 7. Then, the holder portion 6 is folded down at the joining portion 2*h,* and the hooking tab 6*c* on the end of the holder portion 6, which lies on a free-end edge, is engaged with the engagement hole 3 so that the insulator 8*a* is held between the enclosing section 6*b* and the side panel 2*d* to hold the probe 8.

The satellite broadcast receiving converter according to the present invention has been described in conjunction with the arrangement and assembly thereof. In operation, two types of polarized waves orthogonal to each other are guided from the waveguide 2 into the hollow 2*e*. The horizontally polarized waves are reflected by a portion of the ground conductor 10 which is laid over the underside of the bridge 9*g,* and are then detected by the first end 8*c* of the probe 8 extending into the hollow 2*e*. The vertically polarized waves are reflected off of the lid 7*a* of the short-circuit wall 7, and are then detected by the probe 11 formed over the bridge 9*h*. The horizontally polarized waves detected by the probe 8 are transmitted as horizontally polarized signals to an electric circuit contained on the circuit board 9 via the core conductor 8*b*. The vertically polarized waves detected by the probe 11 are transmitted as vertically polarized signals to the electric circuit on the circuit board 9. The horizontally and vertically polarized signals transmitted from the probes 8 and 11, respectively, are combined on the circuit board 9.

It is to be understood that the foregoing embodiment is only illustrative and the satellite broadcast receiving converter according to the present invention is not to be limited to the foregoing embodiment. Various changes and modifications may be contemplated without departing from the spirit and scope of the invention. For example, modifications of the holder portion 6 are illustrated in FIGS. 8 and 9. The holder portion 6 may not have a hooking tab, as shown in FIG. 8, and may hold the insulator 8*a* in such a manner that the holder portion 6 is left folded down at the joining portion 2*h*. The holder portion 6 shown in FIG. 9 encloses substantially the entire circumference of the insulator 8*a* and holds it.

It is also to be understood that the folding guide line 5 is not to be limited to one having cuts, as in the foregoing embodiment, but may be one having perforations or the like.

What is claimed is:

1. A satellite broadcast receiving converter comprising:

metal housing formed into a box;

a tubular waveguide; and a box-shaped short-circuit wall which opposes a hollow formed in said waveguide;

wherein said housing, said waveguide, and said short-circuit wall are joined together on a single metal sheet, and said housing, said waveguide, and said short-circuit wall are stamped out of the metal sheet and folded.

2. The satellite broadcast receiving converter according to claim 1, further comprising a circuit board on which an electric circuit is formed, said circuit board being held between and by said housing and an end of said waveguide.

3. The satellite broadcast receiving converter according to claim 2, wherein said waveguide includes, at a free-end edge thereof, a hooking tab engaged with said circuit board.

4. The satellite broadcast receiving converter according to claim 3, further including folding guide means formed in a joining portion joining said housing with said waveguide.

5. The satellite broadcast receiving converter according to claim 4, wherein said folding guide means includes a cut.

6. The satellite broadcast receiving converter according to claim 1, further including folding guide means formed in a joining portion joining said housing with said waveguide.

7. The satellite broadcast receiving converter according to claim 6, wherein said folding guide means includes a cut.

8. The satellite broadcast receiving converter according to claim 2, further including folding guide means formed in a joining portion joining said housing with said waveguide.

9. The satellite broadcast receiving converter according to claim 8, wherein said folding guide means includes a cut.

* * * * *

UNITED STATES PATENT AND TRADEMARK OFFICE

CERTIFICATE OF CORRECTION

PATENT NO. : 6,658,233 B1
DATED : December 2, 2003
INVENTOR(S) : Tomoki Ikeda

It is certified that error appears in the above-identified patent and that said Letters Patent is hereby corrected as shown below:

Column 8,
Line 6, before "metal housing" insert -- a --.

Signed and Sealed this

Third Day of February, 2004

JON W. DUDAS
*Acting Director of the United States Patent and Trademark Office*